US010631611B2

(12) United States Patent
Chan

(10) Patent No.: US 10,631,611 B2
(45) Date of Patent: Apr. 28, 2020

(54) APPARATUS FOR APPLYING HAIR BANDS

(71) Applicant: Conair Corporation, Stamford, CT (US)

(72) Inventor: Hon Hung Joseph Chan, Hong Kong (CN)

(73) Assignee: Conair Corporation, Stamford, CT (US)

( * ) Notice: Subject to any disclaimer, the term of this patent is extended or adjusted under 35 U.S.C. 154(b) by 520 days.

(21) Appl. No.: 15/463,684

(22) Filed: Mar. 20, 2017

(65) Prior Publication Data

US 2018/0263352 A1 Sep. 20, 2018

(51) Int. Cl.

| | |
|---|---|
| ***A45D 7/02*** | (2006.01) |
| ***A45D 8/34*** | (2006.01) |
| ***A45D 8/00*** | (2006.01) |
| ***A45D 44/00*** | (2006.01) |

(52) U.S. Cl.

CPC ..... *A45D 8/34* (2013.01); *A45D 8/00* (2013.01); *A45D 44/00* (2013.01); *A45D 2008/002* (2013.01); *A45D 2008/008* (2013.01)

(58) Field of Classification Search

CPC ..... A45D 8/34; A45D 2008/002; A45D 8/36; A45D 8/14

See application file for complete search history.

(56) References Cited

U.S. PATENT DOCUMENTS

| | | | | |
|---|---|---|---|---|
| 6,164,291 | A * | 12/2000 | Filippone | A45D 8/34 132/273 |
| 7,069,935 | B2 * | 7/2006 | Bousfield | A45D 2/00 132/210 |
| 7,905,237 | B2 * | 3/2011 | Noh | A45D 2/00 132/210 |
| 2009/0283108 | A1 * | 11/2009 | Brouillard | A45D 7/00 132/212 |
| 2010/0132826 | A1 * | 6/2010 | Chang | A41G 5/0046 139/451 |
| 2016/0242521 | A1 * | 8/2016 | Perez | A45D 8/34 |
| 2017/0099927 | A1 * | 4/2017 | Whitehead | A45D 8/34 |
| 2018/0249804 | A1 * | 9/2018 | Walker | A45D 20/18 |

* cited by examiner

*Primary Examiner* — Nicholas D Lucchesi
(74) *Attorney, Agent, or Firm* — Lawrence Cruz, Esq.; Ryan, Mason & Lewis, LLP

(57) ABSTRACT

An applicator apparatus is adapted to individually and sequentially apply one or more hair bands to strands of hair. The applicator apparatus incorporates first and second band lifters which undergo a sequence of movements to engage hair bands supported by a band cartridge and advance the hair bands along the band cartridge for release on the strands of hair. The band cartridge supports the hair bands in spaced relation for sequential engagement of individual hair bands and maneuvering by the first and second hair band lifters.

15 Claims, 6 Drawing Sheets

APPARATUS FOR APPLYING HAIR BANDS

BACKGROUND

Technical Field

The present disclosure relates to an apparatus for applying a hair accessory to hair, and, more particularly, relates to an apparatus for selectively applying a plurality of hair bands to strands of hair.

Conventional methodologies for applying elastic hair bands to one or more strands of hair include manually grouping together a select number of hair strands and passing the hair band about the ends of the hair strands, and towards the scalp. This process is repeated to apply a number of hair bands about the hair strands. Inherent shortcomings associated with this methodology include the difficulty and/or awkwardness coupled with positioning and placing the hair bands, which results in a relatively inefficient, error-prone application technique. Thus, there is a need for an effective hair band application device that can automatically and efficiently apply hair bands onto strands of hair.

SUMMARY

Accordingly, the present disclosure is directed to an apparatus for applying hair bands to strands of hair. The apparatus includes a handle, an applicator head coupled to the handle, and defining a longitudinal axis and having a longitudinal opening for reception of strands of hair, a band cartridge mounted to the applicator head and supporting a plurality of hair bands, and a hair band dispenser mechanism mounted at least partially in the applicator head. The hair band dispenser mechanism includes first and second band lifters on opposed sides of the longitudinal axis. The first and second band lifters are configured to move in radial inward directions to engage the hair bands of the band cartridge and translate in longitudinal directions to longitudinally displace the hair bands along the band cartridge for release on the strands of hair. A motor is operatively coupled to the first and second band lifters and configured to effect movement of the first and second band lifters.

The first and second band lifters each may include a plurality of longitudinally spaced teeth with longitudinally adjacent teeth defining a groove therebetween configured to receive an individual hair band. The band cartridge may be configured for releasable mounting to the applicator head. The band cartridge may be in general alignment with the longitudinal axis and defines a longitudinal passage for reception of the strands of hairs.

A cam member may be operatively coupled to the motor. The cam member is configured to rotate to move the first and second band lifters between first and second longitudinal positions and between radial inward and radial outward conditions. A cam member may be associated with each of the first and second band lifters.

A manually engageable actuator may be provided and configured to actuate the motor. A switch may be in communication with the motor to deactivate the motor upon movement of the first and second band lifters to the first longitudinal position.

In another embodiment, an apparatus for applying hair bands to strands of hair includes a handle, an applicator head coupled to the handle, and defining a longitudinal axis and having a longitudinal opening for reception of strands of hair, a band cartridge mounted to the applicator head and supporting a plurality of hair bands, and a hair band dispenser mechanism mounted at least partially in the applicator head. The hair band dispenser mechanism includes first and second band lifters on opposed sides of the longitudinal axis. The first and second band lifters each include a plurality of longitudinally spaced teeth with longitudinally adjacent teeth defining a groove therebetween. The first and second band lifters are configured to sequentially move in the following manner:

1) from a radial outward condition to a radial inward condition at a first longitudinal position whereby grooves of the first and second band lifters receive respective hair bands supported by the band cartridge;
2) from the first longitudinal position to a second longitudinal position to move the hair bands along the band cartridge and relative to the strands of hair;
3) from the radial inward condition to the radial outward condition while in the second longitudinal position whereby the grooves of the first and second band lifters release the hair bands; and
4) from the second longitudinal position to the first longitudinal position while in the radial outward condition.

A motor is operatively coupled to the first and second band lifters and configured to effect movement of the first and second band lifters.

The band cartridge may be releasably mounted to the applicator head and defines a longitudinal passage for reception of the strands of hairs. A manually engageable actuator may be provided and configured to actuate the motor. A switch may be in communication with the motor to deactivate the motor upon movement of the first and second band lifters to the first longitudinal position In another embodiment, a method for applying hair bands to strands of hair is disclosed. The method includes:

introducing strands of hair within a longitudinal opening of an applicator head of an applicator apparatus, the applicator head having a plurality of hair bands disposed in longitudinal spaced relation;

passing the strands of hair through the longitudinal opening of the applicator head;

moving first and second opposed band lifters of a hair band dispenser mechanism disposed at least partially in the applicator head from a radial outward condition to a radial inward condition at a first longitudinal position to engage the hair bands;

translating the first and second opposed band lifters along the longitudinal axis from the first longitudinal position to a second longitudinal position to move the hair bands within the longitudinal opening and relative to the strands of hair whereby an uppermost hair band is released onto the strands of hair;

radially displacing the first and second opposed band lifters from the radial inward condition to the radial outward condition while in the second longitudinal position whereby the first and second opposed band lifters release the hair bands; and returning the first and second opposed band lifters to the first longitudinal position.

The applicator apparatus may include a motor operatively coupled to the first and second opposed band lifters, whereby the method includes activating the motor to effect movement of the first and second opposed band lifters.

The method may include introducing a band cartridge within the longitudinal opening of the applicator head where the band cartridge has the hair bands mounted in spaced relation.

Other features and advantages of the present disclosure will be better appreciated by the following description.

BRIEF DESCRIPTION OF THE DRAWINGS

Various aspects and features of the present disclosure are described hereinbelow with references to the drawings, wherein.

DETAILED DESCRIPTION

Figure 1:
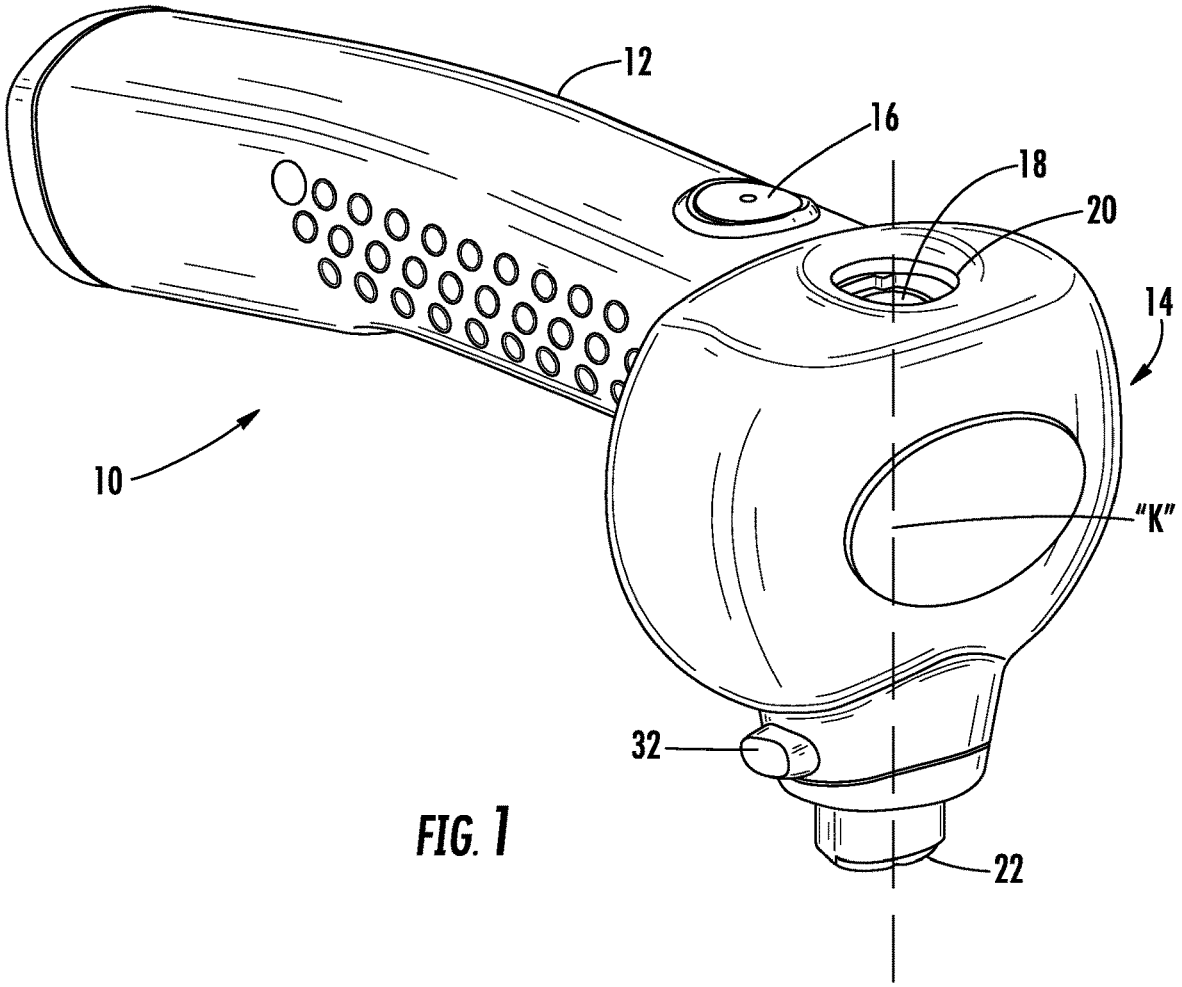
FIG. 1 is a perspective view of an applicator apparatus for applying hair bands in accordance with the principles of the present disclosure.
Figure 2:
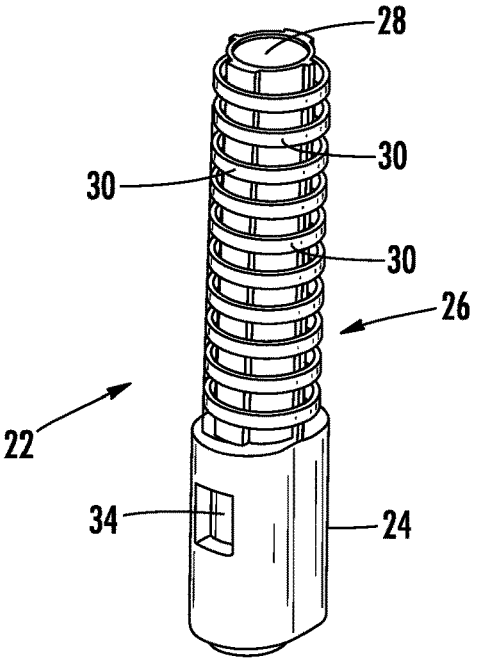
FIG. 2 is a perspective view of a band cartridge for releasable mounting to the applicator apparatus.

Particular embodiments of the present disclosure are described hereinbelow with reference to the accompanying drawings. However, it is to be understood that the disclosed embodiments are merely examples of the disclosure and may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to employ the present disclosure in virtually any appropriately detailed structure.

The applicator apparatus of the present disclosure is adapted to individually and sequentially apply one or more hair bands to strands of hair. In general, the applicator apparatus incorporates first and second band lifters which undergo a sequence of movements to engage hair bands supported by a band cartridge and advance the hair bands along the band cartridge for release on strands of hair. The band cartridge supports the hair bands in spaced relation for sequential engagement of individual hair bands and maneuvering by the first and second hair band lifters.

Referring now to FIGS. 1-4, the applicator apparatus 10 for applying hair bands to strands of hair in accordance with the principles of the present disclosure is illustrated. The applicator apparatus 10 generally includes a handle 12 and an applicator head 14 extending from the handle 12. The handle 12 is contoured for manual engagement by the user, and, in one embodiment, is elongated to enhance manipulation by the user. A switch button or actuator 16 is mounted to the handle 12 to control operation of the applicator apparatus 10.

The applicator head 14 defines a longitudinal axis "k", and has a longitudinal opening 18 extending at least partially along the longitudinal axis "k". The applicator head 14 defines a hair entrance port 20 in communication with, or a component of, the longitudinal opening 18, for reception of strands of hair. A band cartridge 22 is mounted within the longitudinal opening 18 in opposition to the hair entrance port 20. The band cartridge 22 includes a cartridge handle 24 and an elongated band support 26 depending from the cartridge handle 24. The band cartridge 22 defines a longitudinal passage 28 therethrough which receives the strands of hair entering the longitudinal opening 18 of the applicator head 14 through the hair entrance port 20. The elongated band support 26 supports a plurality of hair bands 30 on its exterior. The hair bands 30 are disposed in longitudinal spaced relation, and may be equidistantly spaced along the outer surface of the elongated band support 26. The hair bands 30 may comprise an elastomeric material configured to expand and then return toward its original unexpanded state secured about strands of hair as is conventional in the art. The hair bands 30 may be multi colored, possess ornamental features etc.

The band cartridge 22 may be releasably mounted relative to the applicator head 14. Any conventional methodologies for effecting releasable mounting of the band cartridge 22 to the applicator head 14 are envisioned. In one embodiment, the applicator head 14 includes a cartridge lock button 32 which when in its normal inward position engages corresponding structure, e.g., a locking detent 34 (FIG. 2) of the band cartridge 22 to secure the band cartridge 22 relative to the applicator head 14. The cartridge lock button 32 may be pulled outwardly in the direction of directional arrow "m" (FIG. 3) to release the locking detent 34 of the band cartridge 22 to permit removal of the band cartridge 22 subsequent to, e.g., depletion of the hair bands 30. In another embodiment, the band cartridge 22 may be releasably mounted to the applicator head 14 through a friction or interference fit. Other methodologies are also envisioned.

Figures 3, 4:
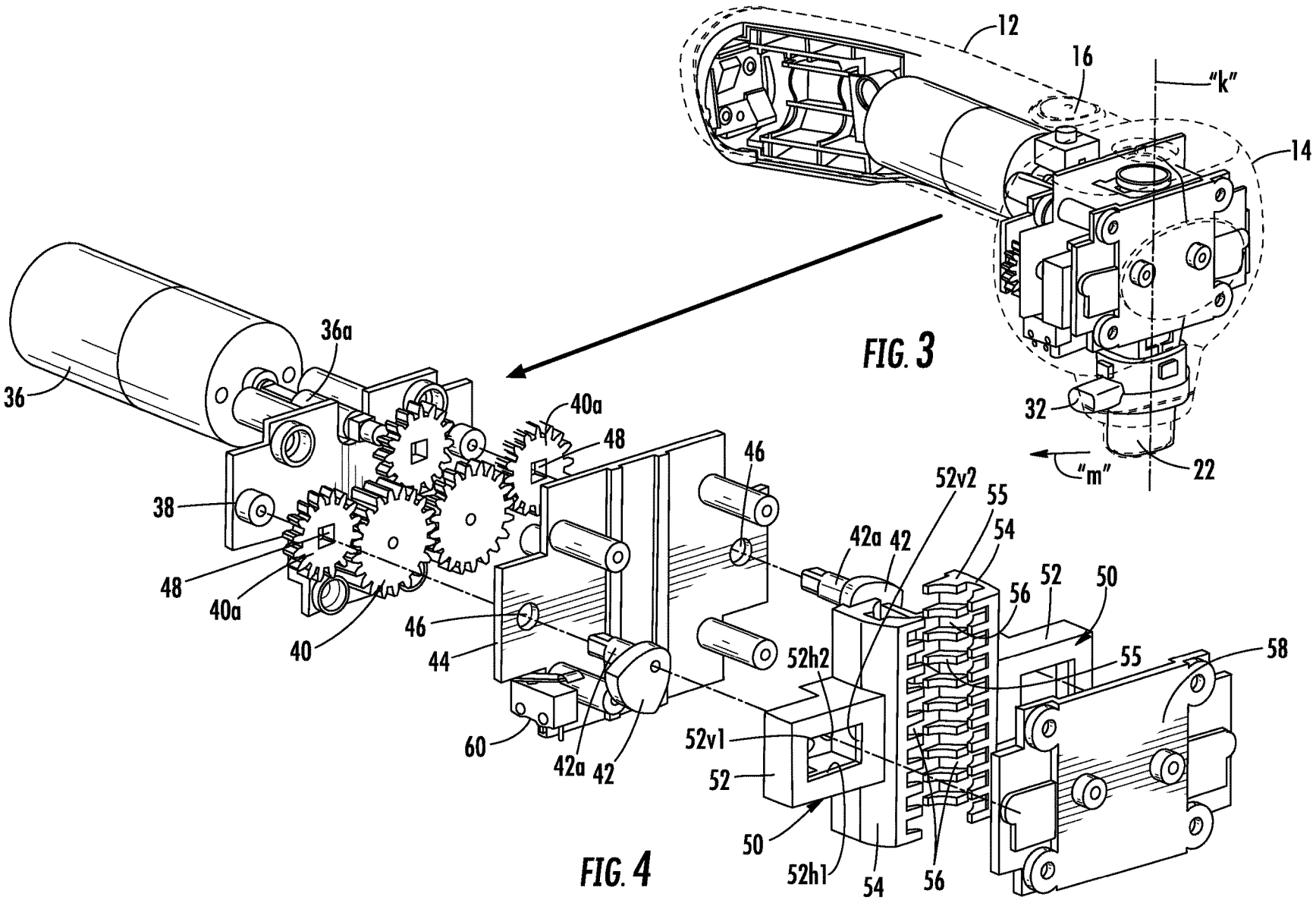
FIG. 3 is a perspective view with portions removed illustrating various components of the applicator apparatus.
FIG. 4 is an exploded perspective view illustrating components of the hair band dispenser mechanism of the applicator apparatus.

Referring now to FIG. 4, the hair band dispenser mechanism of the applicator apparatus 10 will be discussed. The hair dispenser mechanism includes a motor 36, a back plate 38 secured within the applicator head 14 and a planetary gear set 40 coupled to the drive shaft 36*a* of the motor 36 and supported by the back plate 38. A cam member 42 is operatively coupled to each outermost gear 40*a* of the planetary gear set 40 whereby rotation of the outermost 40*a* gears causes corresponding rotation of the cam members 42. The cam members 42 are supported by a middle plate 44 disposed adjacent the planetary gear set 40. In one embodiment, cam shafts 42*a* of the cam members 42 extend through corresponding openings 46 of the middle plate 44 and couple with the outermost gear 40*a* through, e.g., engagement with a corresponding dimensioned aperture 48 of each outermost gear 40*a*. Other arrangements are also envisioned. The cam members 42 may define a reuleaux triangle whereby rotational movement of the cam member 42 may cause horizontal and vertical movement of a component thereby engaged.

The hair band dispenser mechanism further includes first and second band lifters 50 which are disposed on opposed sides of the longitudinal axis "k", e.g., in diametrical opposed relation. The first and second band lifters 50 include cam mounts 52 which at least partially house the cam members 42, and respective first and second band engaging elements 54 coupled to the cam mounts 52. The cam mounts 52 define internal first and second vertical surfaces 52*v*1, 52*v*2 and first and second horizontal surfaces 52*h*1, 52*h*2 which are engaged by the cam members 42 to effect the desired movement of the first and second band lifters 50. The band engaging elements 54 include a plurality of teeth 55. Longitudinally adjacent teeth 55 define band engaging grooves 56 therebetween spaced along the longitudinal axis "k". In one embodiment, the engaging grooves 56 are equidistantly spaced along the longitudinal axis "k". The band engaging grooves 56 are configured to receive respective hair bands 30 on the band support 26 and move the hair bands 30 within the applicator head 14 along the elongated band support 26 of the band cartridge 22 (e.g., through engagement with the teeth 55) and relative to the strands of hair. A front plate 58 supports the first and second band lifters 50 and is secured to the middle plate 44 through conventional means. A microswitch 60 is positioned adjacent the cam mounts 52.

Figure 5A:
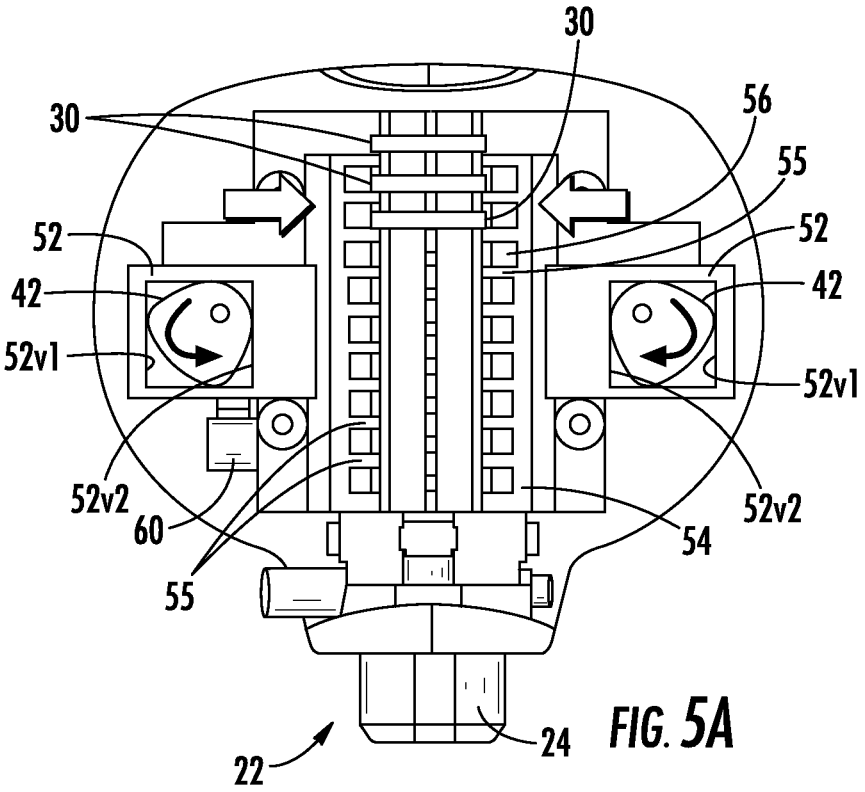
FIGS. 5A-5D are views illustrating a sequence of operation of the first and second band lifters of the hair band dispenser mechanism for dispensing a hair band.
Figure 5B:
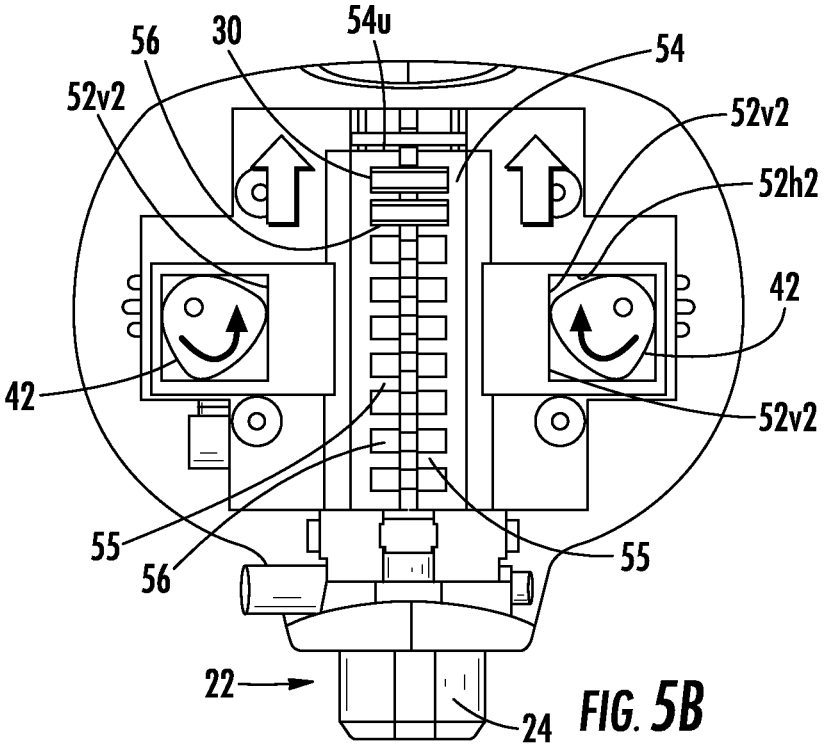
Figure 5C:
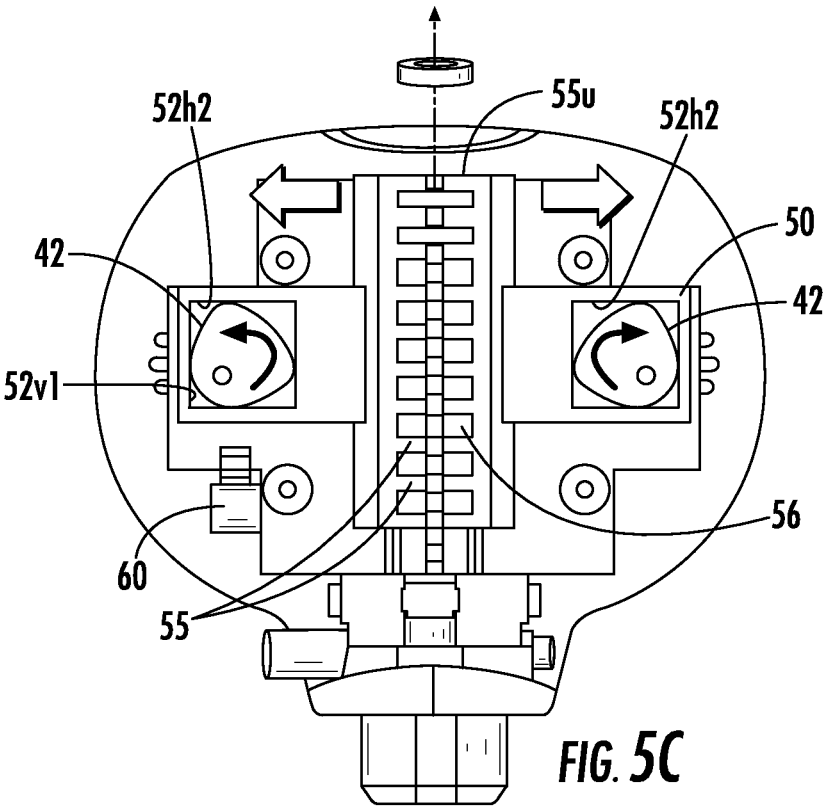
Figure 5D:
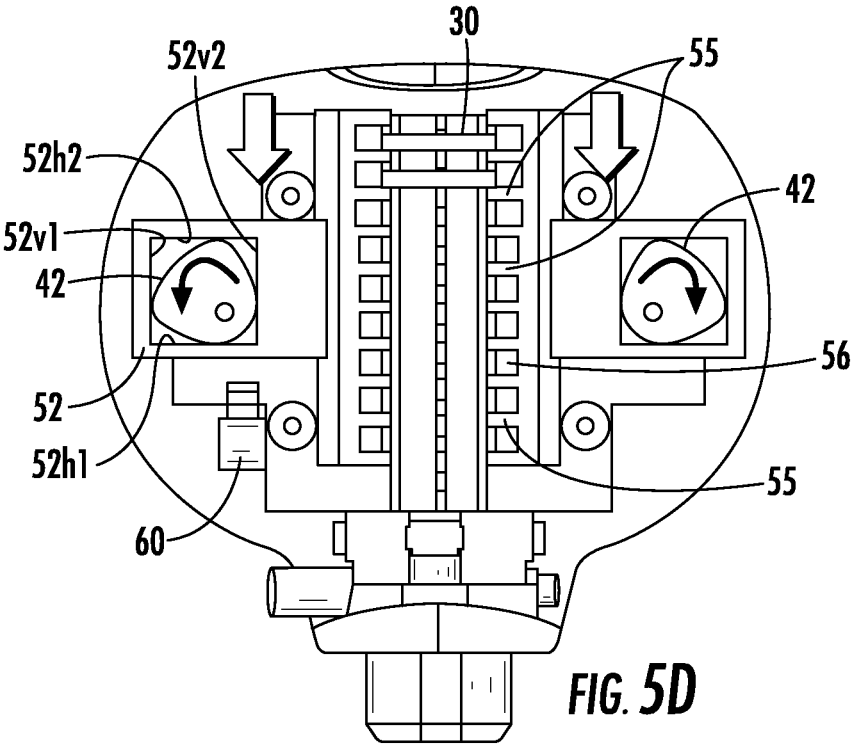

Referring now to FIGS. 5A-5D, the operation of the hair band dispenser mechanism will be discussed. FIG. 5A illustrates the first and second band lifter 50 at a first longitudinal position and in a radial outward condition in position to engage hair bands 30. The user activates the actuator 16 to initiate activation of the hair band dispenser mechanism. The motor 36 is activated to impart movement of the planetary gear system 40 to rotate the cam member 42 from the first position depicted in FIG. 5A to the second position depicted in FIG. 5B. During this movement, the cam member 42 engages at least the second vertical surfaces 52*v*2 of the cam mounts 52 to move the first and second band lifters 50 radially inwardly to a radial inward condition whereby the receiving grooves 56 of the band engaging elements 54 receive and engage the hair bands 30. Continued rotation of the cam members 42 causes the cam mounts 52 to move upwardly through, e.g., engagement with the second horizontal surface 52*h*2 to a second longitudinal position, releasing the uppermost hair band 30 onto hair as depicted in FIG. 5C. In one embodiment, the uppermost tooth 55*u*, or alternatively, an upper most surface of the first and second band lifters 50, drives the uppermost hair band 30 onto the strands of hair "h". The cam members 42 continue to rotate and engage the first vertical surface 52*v*1 to drive the first and second band lifters 50 radially outwardly to a radial outward condition releasing the hair bands 30 as depicted in FIG. 5D. Continued rotation of the cam members 42 returns the cam mounts 52 to the first longitudinal position of FIG. 5A. Upon return to the first longitudinal position, one of the cam mount 52 contacts the microswitch 60 to deactivate the motor 36. The user may activate the actuator 16 to repeat the process and apply a second hair band 30 onto the strands of hair.

Figure 6A:
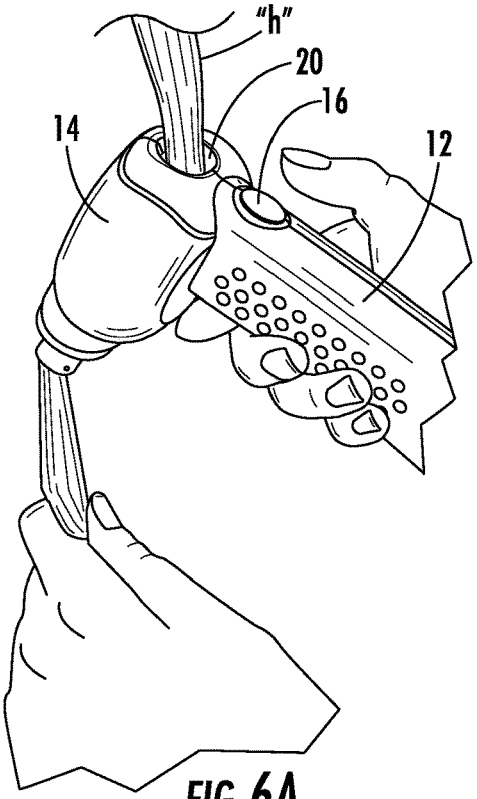
FIGS. 6A-6C are views illustrating use of the applicator apparatus in applying hair bands to strands of hair.
Figure 6B:
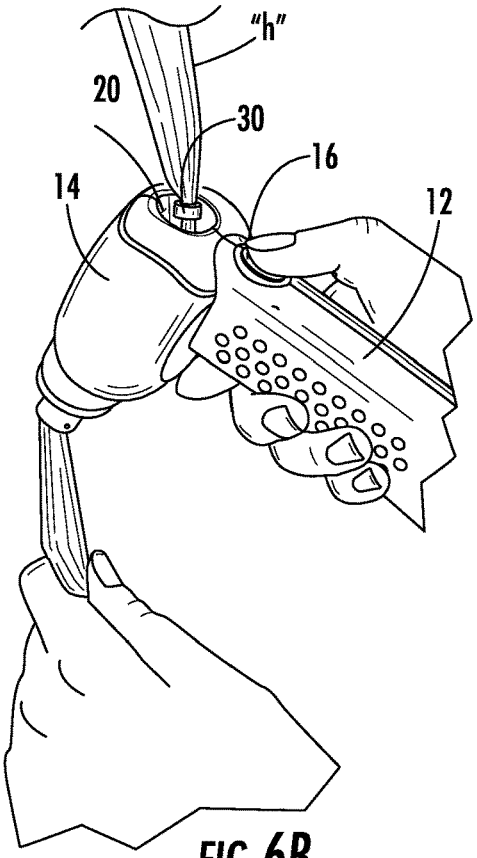
Figure 6C:
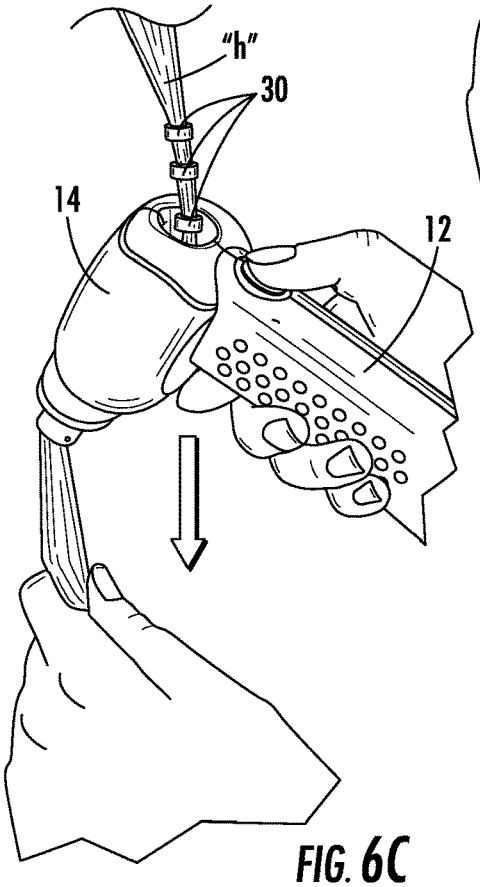

FIGS. 6A-6C illustrate application of hair bands 30 onto strands of hair 'h". The strands of hair 'h" are introduced into the hair entrance port 20 of the applicator head 14 and advanced through the longitudinal passage 28 of the band cartridge 22 as depicted in FIG. 6A. The actuator 16 is actuated to cause the hair band dispenser mechanism to proceed through the sequence of operations discussed in FIGS. 5A-5D to apply a first hair band 30 to the strands of hair "h" as depicted in FIG. 6B. After application of the first band 30 (and all subsequent bands) the microswitch 60 is contacted by the cam mount 52 to stop the motor 36. A next successive band 30 may be applied by activating the actuator 16 to place a second band 30 onto the strands of hair "h". The process may be repeated to position additional bands 30 as depicted in FIG. 6C. Due to the longitudinal spacing of the band engaging grooves 56, the bands 30 are longitudinally spaced along the strands of hair "h" at substantially equal longitudinal increments.

Figure 7:
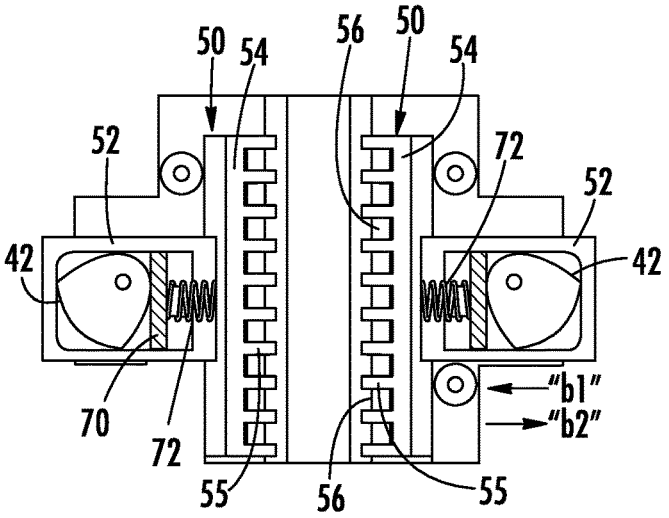
FIG. 7 is a view illustrating an alternate embodiment of the first and second band lifters incorporating a spring biased cam wall to permit use with different size band cartridges.
Figure 8:
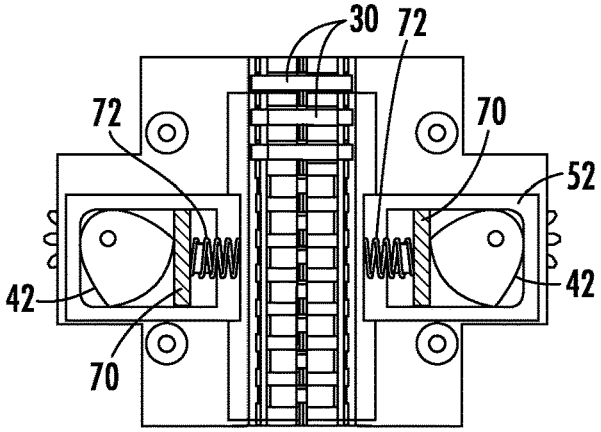
FIG. 8 is a view similar to the view of FIG. 7 illustrating a relative small diameter band cartridge positioned between the first and second band lifters of FIG. 7.
Figure 9:
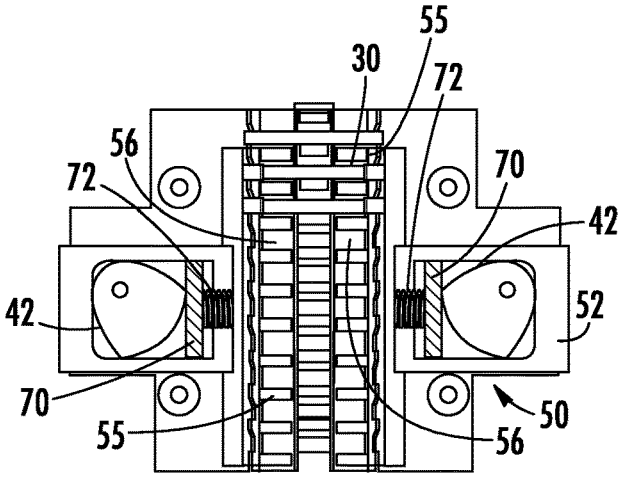
FIG. 9 is a view similar to the view of FIG. 7 illustrating a relative large diameter band cartridge positioned between the first and second band lifters of FIG. 7.

FIG. 7 illustrates an alternate embodiment which permits the applicator apparatus 10 to accommodate different diameter band cartridges 22. In accordance with this embodiment, a spring biased vertical cam wall 70 is disposed in each cam mount 52. Specifically, a cam wall 70 is disposed in each cam mount 52 and adapted for reciprocal lateral movement within the cam mount 52 in the direction of directional arrows "b1, b2". A coil spring 72 engages the cam wall 70 to normally bias the cam wall 70 radially outwardly. Upon insertion of a relatively small diameter band cartridge 22 as depicted in FIG. 8, the cam wall 70 functions in a similar manner to the second vertical surface 52*v*2 discussed hereinabove to maneuver the cam mounts 52 and the first and second band lifters 50 through the sequence of movements discussed hereinabove in connection with FIGS. 5A-5D. It is noted that the spring constant of the coil spring 72 may be selected to minimize or eliminate radial movement of the cam wall 70 such that the cam members 42 rotate to effect the desired movement of the cam mounts 52. FIG. 9 illustrates insertion of a large diameter band cartridge 22 within the applicator head 14. Upon insertion of the large diameter band cartridge 22, the first and second band lifters 50 move radially outwardly with the radial displacing movement being accommodated by compression of the coil spring 72 thereby maintaining the cam wall 70 in the desired position relative to the cam members 42. With either the small diameter band cartridge 22 or a large diameter band cartridge 22 positioned between the first and second band lifters 50, the cam members 42 rotate to engage the respective inner walls of the cam mounts 52 and the cam wall 70 to effect the desired sequence of movement disclosed in connection with FIGS. 5A-5D.

While several embodiments of the disclosure have been shown in the drawings and described herein, it is not intended that the disclosure be limited thereto, as it is intended that the disclosure be as broad in scope as the art will allow and that the specification be read likewise. Therefore, the above description should not be construed as limiting, but merely as examples of particular embodiments. Those skilled in the art will envision other modifications within the scope and spirit of the claims appended hereto.

What is claimed is:

1. An apparatus for applying hair bands to strands of hair, which comprises:

a handle;

an applicator head coupled to the handle, the applicator head defining a longitudinal axis and having a longitudinal opening for reception of strands of hair;

a band cartridge mounted to the applicator head, the band cartridge supporting a plurality of hair bands;

a hair band dispenser mechanism mounted at least partially in the applicator head, the hair band dispenser mechanism including first and second band lifters on opposed sides of the longitudinal axis, the first and second band lifters configured to move in radial inward directions to engage the hair bands of the band cartridge and translate in longitudinal directions to longitudinally displace the hair bands along the band cartridge for release on the strands of hair; and a motor operatively coupled to the first and second band lifters and configured to effect movement of the first and second band lifters.

2. The apparatus according to claim 1 wherein the first and second band lifters each include a plurality of longitudinally spaced teeth, longitudinally adjacent teeth defining a groove therebetween configured to receive an individual hair band.

3. The apparatus according to claim 2 wherein the band cartridge is configured for releasable mounting to the applicator head.

4. The apparatus according to claim 3 wherein the band cartridge is in general alignment with the longitudinal axis and defines a longitudinal passage for reception of the strands of hairs.

5. The apparatus according to claim 1 including a cam member operatively coupled to the motor, the cam member configured to rotate to move the first and second band lifters between first and second longitudinal positions and between radial inward and radial outward conditions.

6. The apparatus according to claim 5 including a cam member associated with each of the first and second band lifters.

7. The apparatus according to claim 6 including a manually engageable actuator configured to actuate the motor.

8. The apparatus according to claim 7 including a switch in communication with the motor to deactivate the motor upon movement of the first and second band lifters to the first longitudinal position.

9. An apparatus for applying hair bands to strands of hair, which comprises:

a handle;

an applicator head coupled to the handle, the applicator head defining a longitudinal axis and having a longitudinal opening;

a band cartridge mounted to the applicator head, the band cartridge supporting a plurality of hair bands;

a hair band dispenser mechanism mounted at least partially in the applicator head, the hair band dispenser mechanism including first and second band lifters on opposed sides of the longitudinal axis, the first and second band lifters each including a plurality of longitudinally spaced teeth with longitudinally adjacent teeth defining a groove therebetween, the first and second band lifters configured to sequentially move in the following manner:

1) from a radial outward condition to a radial inward condition at a first longitudinal position whereby grooves of the first and second band lifters receive respective hair bands supported by the band cartridge;

2) from the first longitudinal position to a second longitudinal position to move the hair bands along the band cartridge and relative to the strands of hair;

3) from the radial inward condition to the radial outward condition while in the second longitudinal position whereby the grooves of the first and second band lifters release the hair bands; and 4) from the second longitudinal position to the first longitudinal position while in the radial outward condition; and a motor operatively coupled to the first and second band lifters and configured to effect movement of the first and second band lifters.

10. The apparatus according to claim 9 wherein the band cartridge is releasably mounted to the applicator head, the band cartridge defining a longitudinal passage for reception of the strands of hairs.

11. The apparatus according to claim 10 including a manually engageable actuator configured to actuate the motor.

12. The apparatus according to claim 11 including a switch in communication with the motor to deactivate the motor upon movement of the first and second band lifters to the first longitudinal position.

13. A method for applying hair bands to strands of hair, comprising:

introducing strands of hair within a longitudinal opening of an applicator head of an applicator apparatus, the applicator head having a plurality of hair bands disposed in longitudinal spaced relation;

passing the strands of hair through the longitudinal opening of the applicator head;

moving first and second opposed band lifters of a hair band dispenser mechanism disposed at least partially in the head from a radial outward condition to a radial inward condition at a first longitudinal position to engage the hair bands;

translating the first and second opposed band lifters along the longitudinal axis from the first longitudinal position to a second longitudinal position to move the hair bands within the longitudinal opening and relative to the strands of hair whereby an uppermost hair band is released onto the strands of hair;

radially displacing the first and second opposed band lifters from the radial inward condition to the radial outward condition while in the second longitudinal position whereby the first and second band lifters release the hair bands; and returning the first and second opposed band lifters to the first longitudinal position.

14. The method according to claim 13 wherein the applicator apparatus includes a motor operatively coupled to the first and second opposed band lifters, and including activating the motor to effect movement of the first and second opposed band lifters.

15. The method according to claim 14 including introducing a band cartridge within the longitudinal opening of the head, the band cartridge having the hair bands mounted in spaced relation.

* * * * *